US011777253B2

(12) United States Patent
Sugaya et al.

(10) Patent No.: US 11,777,253 B2
(45) Date of Patent: Oct. 3, 2023

(54) RECEPTACLE CONNECTOR

(71) Applicant: FUJIKURA LTD., Tokyo (JP)

(72) Inventors: Soichi Sugaya, Tokyo (JP); Kiyotaka Yamada, Tokyo (JP); Yasuyuki Akiyama, Tokyo (JP); Kazunori Takei, Tokyo (JP)

(73) Assignee: FUJIKURA LTD., Tokyo (JP)

( * ) Notice: Subject to any disclaimer, the term of this patent is extended or adjusted under 35 U.S.C. 154(b) by 405 days.

(21) Appl. No.: 17/278,247

(22) PCT Filed: May 24, 2019

(86) PCT No.: PCT/JP2019/020569
§ 371 (c)(1),
(2) Date: Mar. 19, 2021

(87) PCT Pub. No.: WO2020/059210
PCT Pub. Date: Mar. 26, 2020

(65) Prior Publication Data
US 2021/0359466 A1 Nov. 18, 2021

(30) Foreign Application Priority Data
Sep. 19, 2018 (JP) ..... 2018-175189

(51) Int. Cl.
*H01R 13/627* (2006.01)
*H01R 13/502* (2006.01)
*H01R 13/629* (2006.01)

(52) U.S. Cl.
CPC ..... *H01R 13/6275* (2013.01); *H01R 13/502* (2013.01); *H01R 13/629* (2013.01)

(58) Field of Classification Search
CPC ..... H01R 13/6275; H01R 13/502; H01R 13/629; H01R 12/73; H01R 13/6582; H01R 12/716
See application file for complete search history.

(56) References Cited

U.S. PATENT DOCUMENTS

2013/0280926 A1* 10/2013 Ono ..... H01R 12/7052 439/65
2021/0359466 A1* 11/2021 Sugaya ..... H01R 13/502

FOREIGN PATENT DOCUMENTS

CN 103367978 A 10/2013
JP 2013206771 A 10/2013
(Continued)

OTHER PUBLICATIONS

International Search Report and Written Opinion for related PCT App No. PCT/JP2019/020569 dated Aug. 13, 2019, 10 pgs. (partial translation).

*Primary Examiner* — Abdullah A Riyami
*Assistant Examiner* — Nader J Alhawamdeh
(74) *Attorney, Agent, or Firm* — Procopio, Cory, Hargreaves & Savitch LLP

(57) ABSTRACT

A receptacle connector 20 includes a housing 200 in which a recess 203 for housing a plug connector 30 is formed on a side opposite to a surface mounted on a substrate of the housing, a required number of contacts 220 arranged between end portions of the housing 200, and reinforcement metal fittings 230 each of which is provided on one of the end portions of the housing 200. The reinforcement metal fitting 230 has a cantilever resilient piece 235 that extends in the arrangement direction of the contacts 220, and a contact piece 236 that extends from a free end portion of the cantilever resilient piece 235 and comes into contact with the plug connector 30 when the receptacle connector 20 and the plug connector 30 are fitted to each other.

16 Claims, 10 Drawing Sheets

(56) References Cited

FOREIGN PATENT DOCUMENTS

| | | | | | |
|---|---|---|---|---|---|
| JP | 2015135816 | A | | 7/2015 | |
| JP | 2015185541 | A | * | 10/2015 | ..... H01R 12/57 |
| JP | 2015185541 | A | | 10/2015 | |
| JP | 2016085994 | A | | 5/2016 | |
| KR | 20160046173 | A | | 4/2016 | |

* cited by examiner (a)

(b)

(a)

(b)

RECEPTACLE CONNECTOR

CROSS-REFERENCE TO RELATED APPLICATIONS

This application is a U.S. National Stage entry of PCT Application No: PCT/JP2019/020569 filed May 24, 2019, which claims priority to Japanese Patent Application No. 2018-175189 filed Sep. 19, 2018, the contents of which are incorporated herein by reference.

TECHNICAL FIELD

The present invention relates to a receptacle connector of a substrate-to-substrate connector unit that electrically connects substrates to each other by fitting the receptacle connector mounted on one of the substrates and a plug connector mounted on another of the substrates to each other.

BACKGROUND ART

In the recent trend for downsizing of electric and electronic devices and communication devices, connectors are increasingly reduced in size or profile and reduced in strength accordingly. As a result, when connectors are fitted to each other incorrectly, the end portions of the connectors to be fitted to each other can be damaged or break. To prevent this, Patent Literature 1 proposes a technique of increasing the strength of a connector by providing a reinforcement metal fitting on both end portions of the connector. Patent Literature 1 further discloses that, in order to maintain the state that the connector fitted to a counterpart connector, a contact piece (contact arm portion 55) is provided which is convexly curved, hangs from the upper end of the side wall of the reinforcement metal fitting, and comes into contact with the counterpart connector when the connector is fitted to the counterpart connector.

CITATION LIST

Patent Literature

Patent Literature 1: JP-A-2016-85994

SUMMARY OF INVENTION

Technical Problem

However, with the connector described in Patent Literature 1, the contact piece is disposed with the direction of the spring length coinciding with the height direction (direction of insertion and removal). Therefore, as the profile of the connector is made lower, the spring length becomes shorter, the spring characteristics of the contact piece deteriorates, and a stable contact cannot be achieved.

An object of the present invention is to provide a receptacle connector that comes into good contact with a counterpart connector via a contact piece of a reinforcement metal fitting even when the profile of the connector is lowered.

Solution to Problem

To advantageously solve the problem described above, the present invention provides a receptacle connector of a substrate-to-substrate connector unit that electrically connects substrates by fitting the receptacle connector mounted on one of the substrates and a plug connector mounted on another of the substrates to each other, including: a housing in which a recess for housing the plug connector is formed, the recess opening at a side opposite to a surface mounted on the substrate; a required number of contacts arranged between end portions of the housing; and reinforcement metal fittings provided on both end portion of the housing, and the reinforcement metal fitting has a cantilever resilient piece that extends in an arrangement direction of the contacts, and a contact piece that extends from a free end portion of the cantilever resilient piece and comes into contact with the plug connector when the receptacle connector and the plug connector are fitted to each other.

According to a preferred aspect of the present invention, the contact piece extends in a height direction of the housing.

According to a preferred aspect of the present invention, the reinforcement metal fitting has a top wall formed along a surface of the housing that is opposite to the substrate mounting surface, and a tip end portion of the contact piece is hidden by the top wall when viewed in a direction of fitting the plug connector to the receptacle connector.

According to a preferred aspect of the present invention, the contact piece has an inwardly convex curved portion between a base end portion thereof and a tip end portion thereof.

According to a preferred aspect of the present invention, the reinforcement metal fitting has two pieces of the cantilever resilient pieces and two pieces of the contact pieces, the two cantilever resilient pieces are disposed at locations where the cantilever resilient pieces are opposed in a direction perpendicular to the arrangement direction, and the two contact pieces are disposed at locations where the contact pieces are opposed in the direction perpendicular to the arrangement direction.

According to a preferred aspect of the present invention, the reinforcement metal fitting is fixed to the housing by integrally forming the reinforcement metal fitting with the housing when forming the housing.

Advantageous Effects of Invention

According to the present invention, the contact piece of the reinforcement metal fitting provided at the end portion of the housing of the receptacle connector is supported on the free end portion of the cantilever resilient piece extending in the arrangement direction of the contacts, and therefore, even if the profile of the receptacle connector is reduced, a sufficient spring length can be ensured, and the contact piece can come into stable contact with the plug connector.

DESCRIPTION OF EMBODIMENTS

In the following, receptacle connectors according to embodiments of the present invention will be described in detail with reference to the drawings. A receptacle connector according to an embodiment forms a substrate-to-substrate connector unit in corporation with a plug connector, which is a counterpart connector. The substrate-to-substrate connector unit is an electrical connector unit that electrically connects substrates to each other by fitting a receptacle connector mounted on one of the substrates and a plug connector mounted on another of the substrates to each other. The substrates are not particularly limited in type or shape as far as the receptacle connector and the plug connector can be mounted thereon, and can be rigid substrates, flexible substrates (FPC), or rigid flexible substrates (rigid FPC), for example. In the following description, a bottom or lower surface of the receptacle connector or the plug connector means a surface thereof at which the connector is mounted on a substrate, and an upper surface means a surface opposite to the bottom or lower surface. The mounting method is not limited to the surface mounting method that involves soldering onto a substrate surface but may be the DIP mounting that involves inserting a part into a through-hole in a substrate and soldering the part to the substrate or press-fitting.

Figure 1:
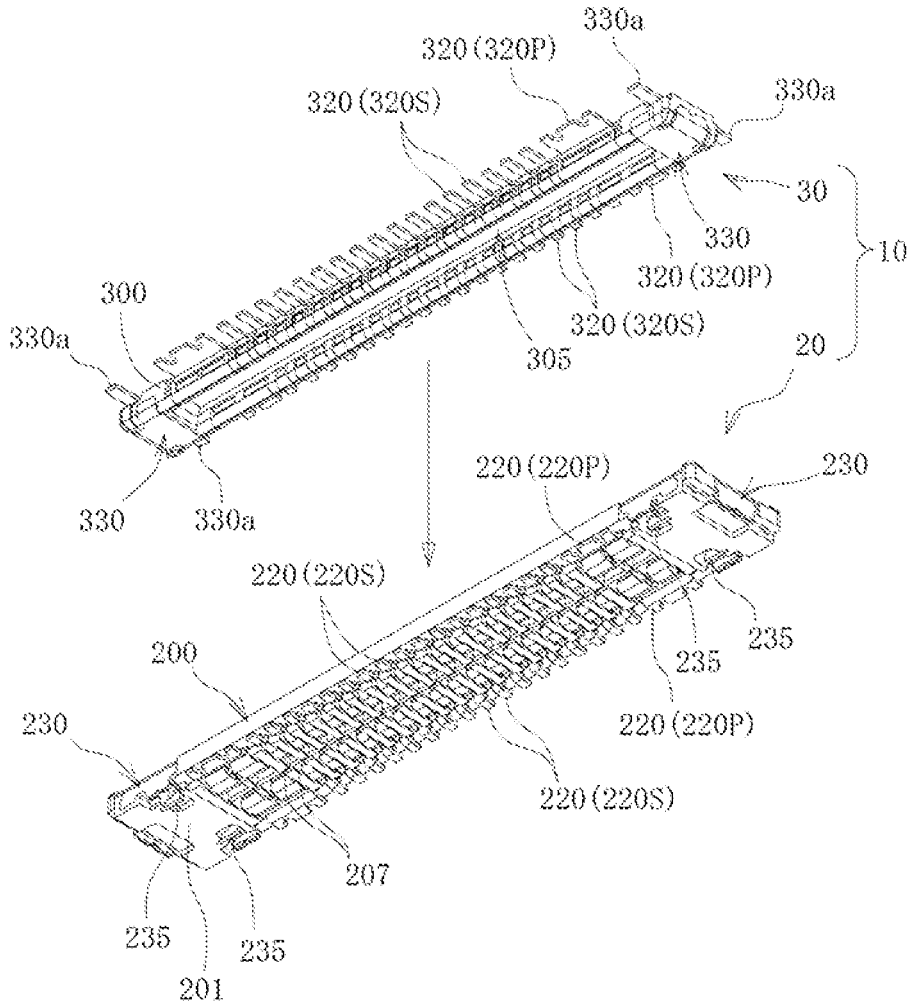
FIG. 1 is a perspective view of a receptacle connector according to an embodiment of the present invention and a plug connector, which is a counterpart connector, in which the arrow indicates the direction of fitting the receptacle connector and the plug connector to each other.

FIG. 1 shows a receptacle connector 20 and a plug connector 30 of a substrate-to-substrate connector unit 10 in a separated state (a disconnected state). The arrow in the drawing indicates the fitting direction (connecting direction) of the receptacle connector 20 and the plug connector 30. The receptacle connector 20 and the plug connector 30 can be attached to and detached from each other.

Figure 2:
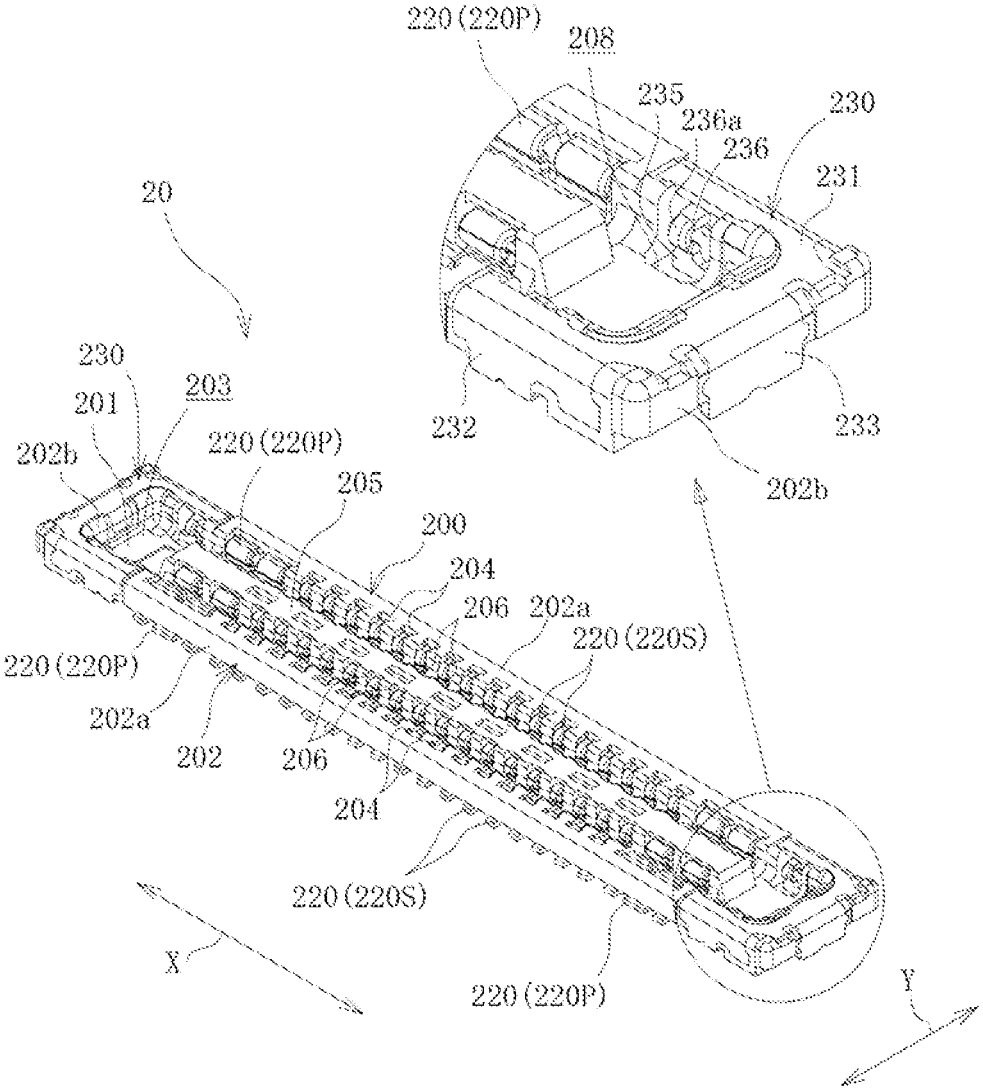
FIG. 2 is a top perspective view of the receptacle connector in FIG. 1.

As shown in FIG. 2, the receptacle connector 20 mainly includes a housing 200, a required number of contacts 220, and a reinforcement metal fitting 230.

The housing 200 is fabricated by injection shaping or the like of an electrical insulating synthetic resin material. The synthetic resin material may be liquid crystal polymer (LCP), polyphenylene sulfide (PPS), poly butylene terephthalate (PBT) or polyamide (PA), although the synthetic resin material is not limited to these materials. The material of the housing 200 may contain an inorganic filler, a reinforcement fiber or the like.

The housing 200 substantially has the shape of a flat rectangular parallelepiped. The housing 200 has a bottom wall 201 and a circumferential wall 202 rising from a circumferential edge of the bottom wall 201. The bottom wall 201 and the circumferential wall 202 define a recess 203 that opens at the top thereof.

The circumferential wall 202 has side wall portions 202*a* opposed to each other that extend in an arrangement direction (longitudinal direction of the housing 200) X of the contacts 220, and end wall portions 202*b* opposed to each other that extend in a direction (widthwise direction of the housing) Y perpendicular to the arrangement direction of the contacts 220. In an inner surface of the side wall portion 202*a*, outer portion housing grooves 204 substantially having a T-shape in plan view each of which houses an outer portion of each contact 220 are formed. The outer portion housing groove 204 penetrates the housing 200 in a height direction (thickness direction). The outer portion housing groove 204 is preferably dimensioned to be in pressure contact with the contact when the contact 220 is inserted and fitted in the outer portion housing groove 204. Alternatively, the contact 220 may be integrated with the housing 200 in the injection shaping of the housing 200. That is, the contacts 220 may be held (set) in a die (not shown) as insert bodies and then fixed to (made to be held in) the housing 200 by injecting (charging) an electrical insulating synthetic resin material, which is to form the housing 200, into the space for forming the housing 200.

The housing 200 further has a raised part 205 having a rectangular shape in plan view that is formed on the bottom wall 201 and is spaced apart from the circumferential wall 202. Therefore, the recess 203 is defined as an annular space. In side surfaces of the raised part 205 that is opposed to the side wall portions 202*a*, inner portion housing grooves 206 that house inner portions of the contacts 220 are formed. The inner portion housing grooves 206 are provided at locations where the inner portion housing grooves 206 are opposed to the outer portion housing grooves 204 and extend in the height direction of the housing 200. In the inner portion housing groove 206, an inclined portion 206*a* (FIGS. 5(*b*) and 5(*c*)) having a curved shape is formed. The inclined portion 206*a* conforms to an inclined portion 225*a* of an inner contact portion 225 of the contact 220. The inclined portion 206*a* is a portion that adjusts a movement (supporting function) for preventing lifting of the inner contact portion 225 of the contact 220 or deformation of the contact 220, when the plug connector 30, which is a counterpart connector, is removed, and ensures a stable connection after repeated insertions and removals of the plug connector 30. The shape and size of the inclined portion 206*a* of the inner portion housing groove 206 depend on the shape and size of the inclined portion 225*a* of the inner contact portion 225 of the contact 220, and are appropriately determined by considering the functions thereof described above, the connection stability, the workability and the like.

Figure 3:
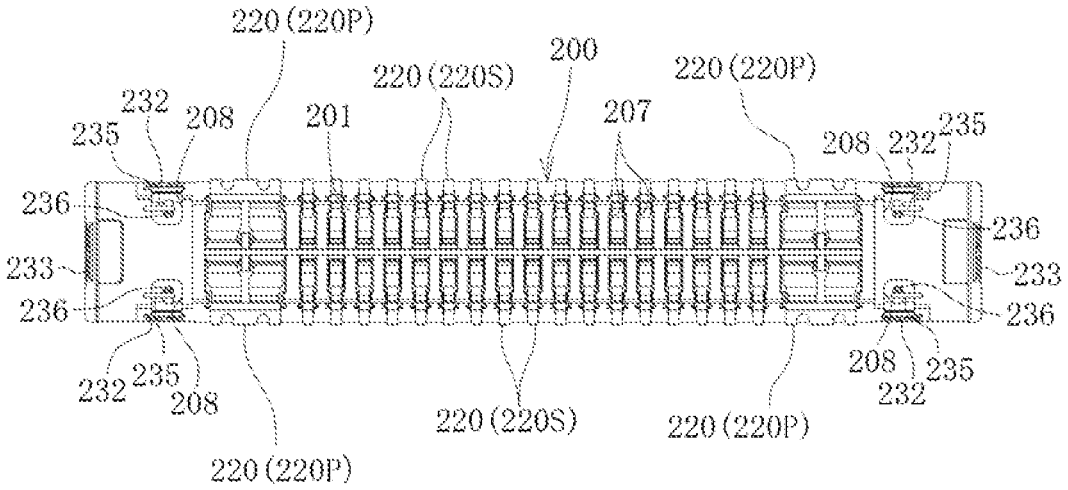
FIG. 3 is a bottom view of the receptacle connector in FIG. 1.

As shown in FIGS. 1 and 3, openings 207 that are in communication with the outer portion housing grooves 204 and the inner portion housing grooves 206 are formed in the bottom wall 201. When assembling the contacts 220 to the housing 200 by insertion, the contacts 220 can be inserted through the openings 207 from the bottom surface side.

Figure 4:
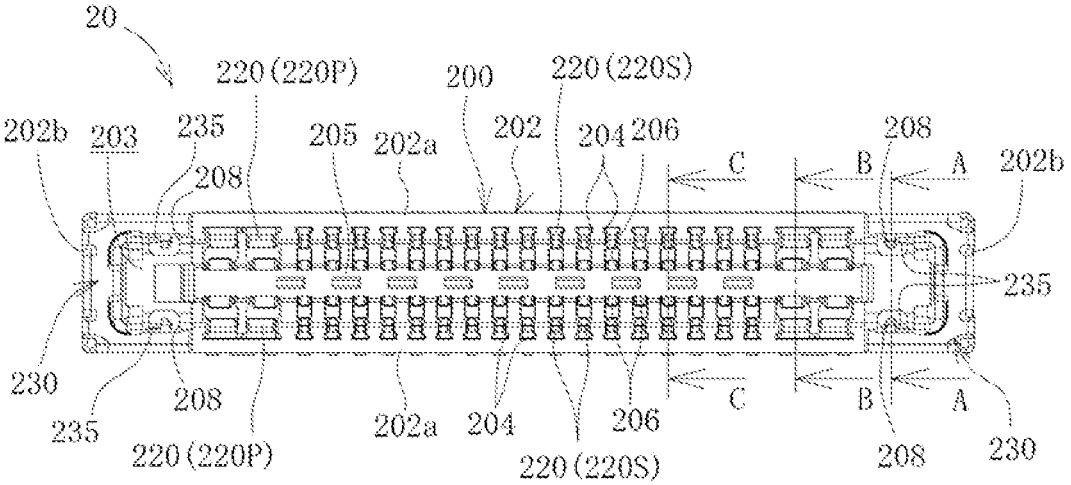
FIG. 4 is a plan view of the receptacle connector in FIG. 1.

As shown in FIG. 4, the contacts 220 are made of a conductive metal, preferably copper or a copper alloy, and include signal contacts 220S having a smaller width and power supply contacts 220P having a greater width. However, all the contacts 220 may be signal contacts 220S. When both signal contacts 220S and power supply contacts 220P are provided, the signal contacts 220S and the power supply contacts 220P may have the same shape and dimensions.

Figure 5:
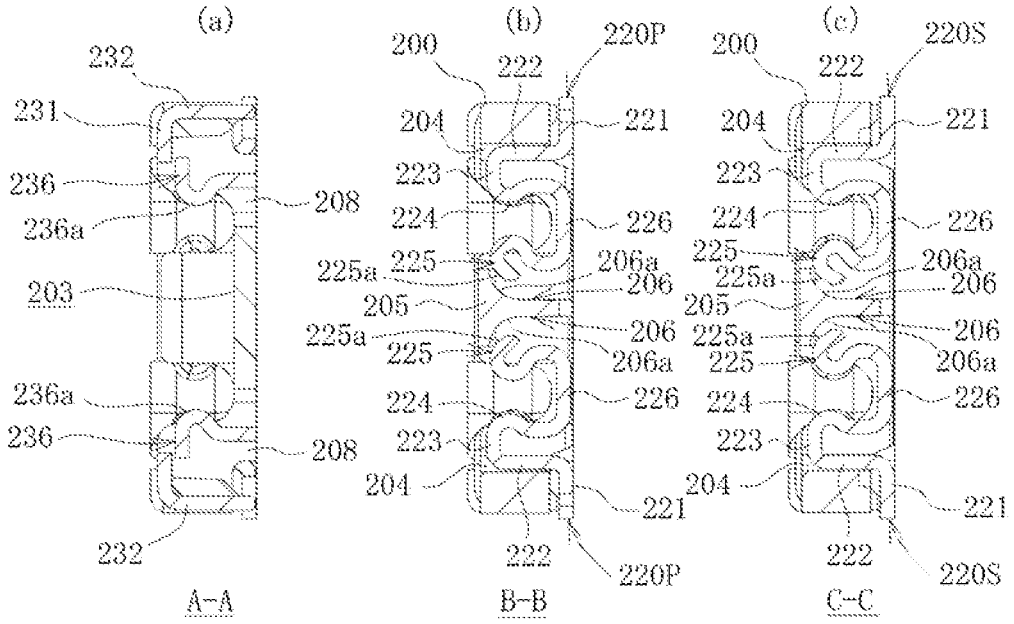
FIG. 5 are widthwise cross-sectional view of the receptacle connector in FIG. 1, FIG. 5(*a*) is a cross-sectional view taken along the line A-A in FIG. 4, FIG. 5(*b*) is a cross-sectional view taken along the line B-B in FIG. 4, and FIG. 5(*c*) is a cross-sectional view taken along the line C-C in FIG. 4.

As shown in FIGS. 5(*b*) and 5(*c*), each contact 220 (220S, 220P) has a connection portion 221 to be mounted on the substrate, a held portion 222 that extends from the connection portion 221 in the height direction of the housing 200 and is held in the outer portion housing groove 204, an extension portion 223 that extends from an upper end of the held portion 222 toward the raised part 205, an outer contact portion 224 that is convexly curved toward the raised part 205, an inner contact portion 225 that is opposed to the outer contact portion 224 and is convexly curved toward the outer contact portion 224, and a coupling portion 226 that has a U-shaped cross section and couples the outer contact portion 224 and the inner contact portion 225 to each other. The contact 220 has only to be able to come into contact with a contact 320 of the plug connector 30 described later, and the structure of the contact 220 is not limited to the illustrated example. For example, the contact 220 may have only one contact portion (224 or 225). The inclined portion 225*a* formed on the inner contact portion 225 is configured to conform to (i.e., have a shape substantially corresponding to the shape of) the inclined portion 206*a* of the inner portion housing groove 206 of the housing 200. Thus, the inclined portion 225*a* of the inner contact portion 225 is a portion that adjusts a movement (supporting function) for preventing lifting of the inner contact portion 225 of the contact 220 or deformation of the contact 220, when the plug connector 30, which is a counterpart connector, is removed, and ensures a stable connection after repeated insertions and removals of the plug connector 30. The shape and size of the inclined portion 225*a* formed on the inner contact portion 225 depend on the shape and size of the inclined portion 206*a* of the inner portion housing groove 206 of the housing 200, and are appropriately determined by considering the functions thereof described above, the connection stability, the workability and the like.

Referring back to FIGS. 1 and 2, the reinforcement metal fitting 230 is made of a metal, preferably a conductive metal such as copper or copper alloy, and partially covers longitudinal end portions of the housing 200. The end portions of the housing 200 are reinforced in this way. The reinforcement metal fitting 230 serves also as a fixing tab that fixes the housing 200 to the substrate.

Figure 6:
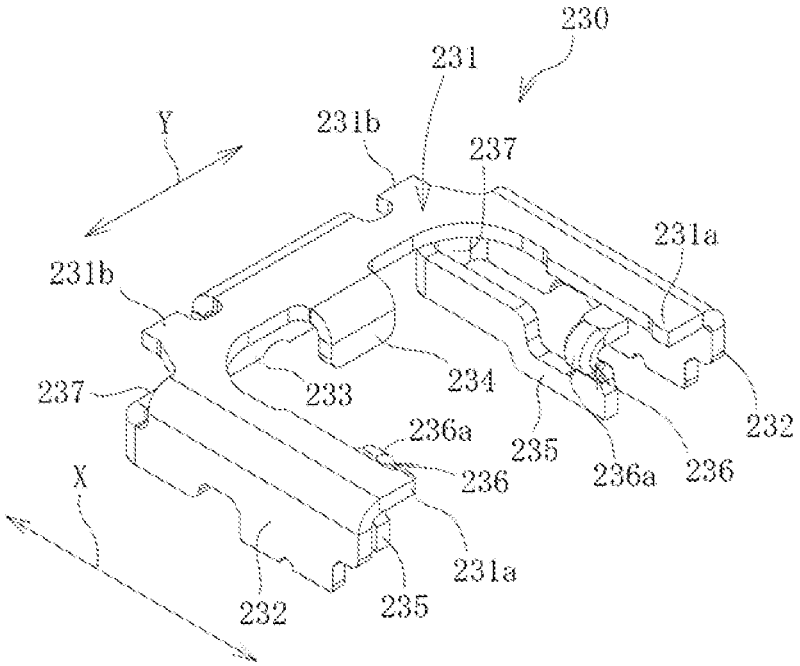
FIG. 6 show a reinforcement metal fitting provided on a longitudinal end portion of a housing of the receptacle connector in FIG. 1, FIG. 6(*a*) is a perspective view of the reinforcement metal fitting viewed from the side of an upper surface thereof, and FIG. 6(*b*) is a perspective view of the reinforcement metal fitting viewed from the side of a lower surface thereof.
Figure 6:
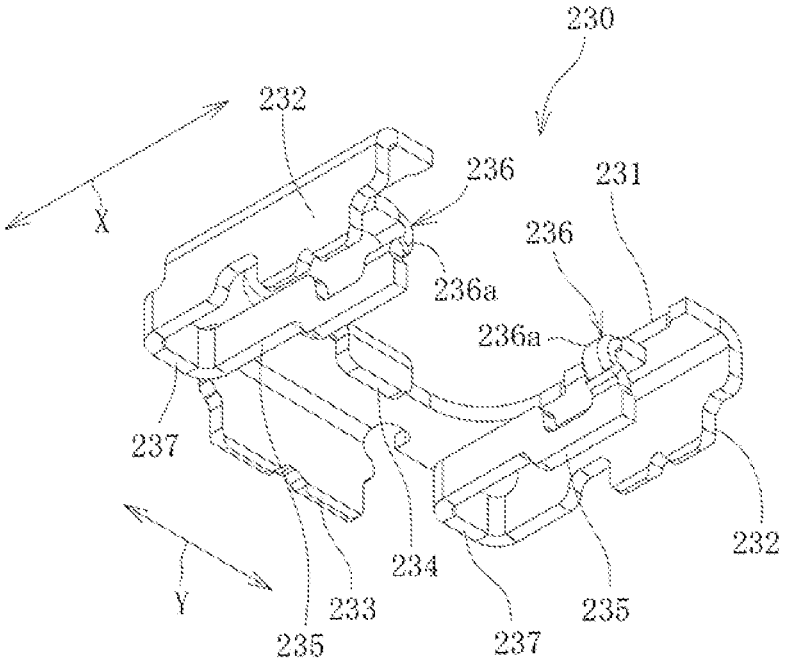

FIG. 6 shows the reinforcement metal fitting 230 alone. The reinforcement metal fitting 230 is integrated with the housing 200 in the injection shaping of the housing 200. That is, the reinforcement metal fitting 230 is held (set) in a die (not shown) as an insert body and then fixed to (made to be held in) the housing 200 by injecting (charging) a synthetic resin material of the housing 200 into the space for forming the housing 200. Alternatively, the reinforcement metal fitting 230 may be fixed to the housing 200 by insertion (press fitting) and/or bonding after the housing 200 is formed.

The reinforcement metal fitting 230 mainly includes a top wall 231, a pair of hanging side walls 232 opposed in a widthwise direction Y of the housing 200, a hanging end wall 233, a hanging piece 234, cantilever resilient pieces 235 and contact pieces 236. The reinforcement metal fitting 230 is formed by bending an intermediate piece having a predetermined shape and predetermined dimensions formed by cutting a metal plate material by stamping, for example.

The top wall 231 substantially has a C-shape in plan view and extends along an upper surface of the side wall portion 202*a* and an upper surface of the end wall portion 202*b* of the circumferential wall 202 (surfaces opposite to the surface mounted on the substrate) at a longitudinal end portion of the housing 200. In opposed inner side and a rear side of the top wall 231, engagement portions 231*a* and 231*b* to be engaged with the housing 200 are preferably formed. The engagement portions 231*a* are engaged with the housing 200 in a longitudinal direction X and restricts a relative movement in the longitudinal direction X. The engagement portions 231*b* are engaged with the housing 200 in the widthwise direction Y and restricts a relative movement in the widthwise direction Y.

The hanging side wall 232 hangs from an outer side edge of the top wall 231 along an outer surface of the side wall portion 202*a* of the circumferential wall 202 and is mounted on and fixed to the substrate at the lower end thereof. The hanging end wall 233 hangs from a rear side (outer end edge) of the top wall 231 along an outer surface of the end wall portion 202*b* of the circumferential wall 202 and is mounted on and fixed to the substrate at the lower end thereof. The hanging side walls 232 and the hanging end wall 233 are flush with the outer surface of the circumferential wall 202.

The hanging piece 234 hangs from an inner end edge of the top wall 231 along an inner surface of the end wall portion 202*b* of the circumferential wall 202, and the end wall portion 202*b* is held between the hanging piece 234 and the hanging end wall 233. The hanging piece 234 is flush with the inner surface of the circumferential wall 202.

The cantilever resilient piece 235 is integrally coupled to each hanging side wall 232 by a vertical extension wall 237 that extends from a side edge of the hanging side wall 232 located on the outer side in the longitudinal direction X toward the other hanging side wall 232. The cantilever resilient piece 235 extends in the arrangement direction of the contacts 220 (longitudinal direction X of the housing 200). As shown in FIG. 1, in order that the cantilever resilient piece 235 has a predetermined spring length, a free end portion of the cantilever resilient piece 235 is exposed from the resin material of the housing 200, and the remaining portion is embedded in the resin material of the housing 200. To expose the free end portion of the cantilever resilient piece 235, a through-hole 208 (see FIGS. 2 and 3) is formed in the bottom wall 201 of the housing 200 at a part near the free end portion of the cantilever resilient piece 235. The whole of the cantilever resilient piece 235 may be exposed from the resin material of the housing 200. The reinforcement metal fitting 230 further has a contact piece 236 that extends from the free end portion of the cantilever resilient piece 235 and comes into contact with the plug connector 30 when the receptacle connector 20 and the plug connector 30 are fitted to each other. The contact piece 236 is supported on the cantilever resilient piece 235 having a predetermined spring length, and therefore, even if the profile of the receptacle connector 20 is reduced, a sufficient spring length can be ensured, and the contact piece 236 can come into stable contact with the plug connector 30.

According to a preferred aspect, the contact piece 236 extends in the height direction of the housing 200 or, in other words, extends from the free end portion of the cantilever resilient piece 235 toward the top wall 231.

According to a more preferred aspect, when viewed in the direction of fitting the plug connector 30 to the receptacle connector 20, a tip end portion of the contact piece 236 is hidden by the top wall 231. This prevents an inappropriate fitting, such as a back fitting of the plug connector 30.

According to a more preferred aspect, the contact piece 236 has a curved portion 236*a* between a base end portion thereof and the tip end portion thereof, the curved portion 236*a* being inwardly convex or, in other words, protruding to the inside of the recess 203. This facilitates smooth insertion and removal of the plug connector 30 into and from between the contact pieces 236 opposed in the widthwise direction Y.

Figure 7:
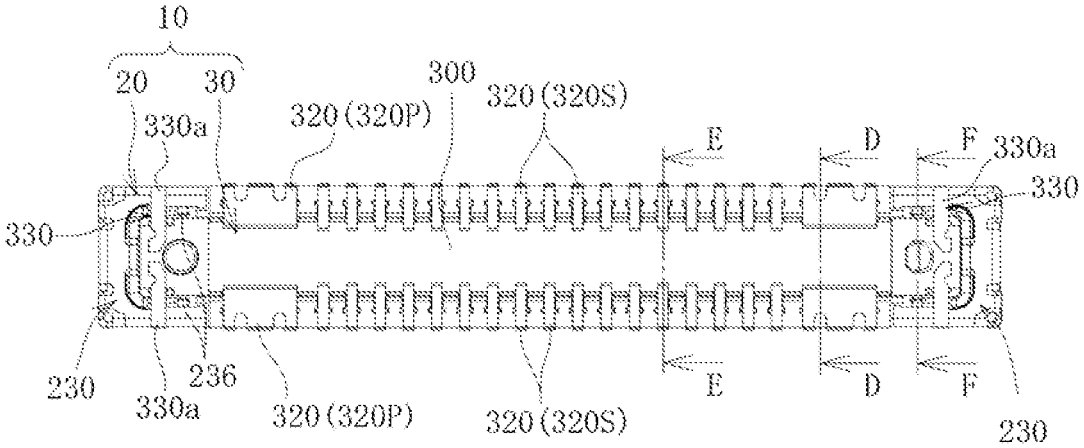
FIG. 7 is a plan view of a substrate-to-substrate connector unit with the receptacle connector in FIG. 1 and a plug connector fitted to each other.
Figure 8:
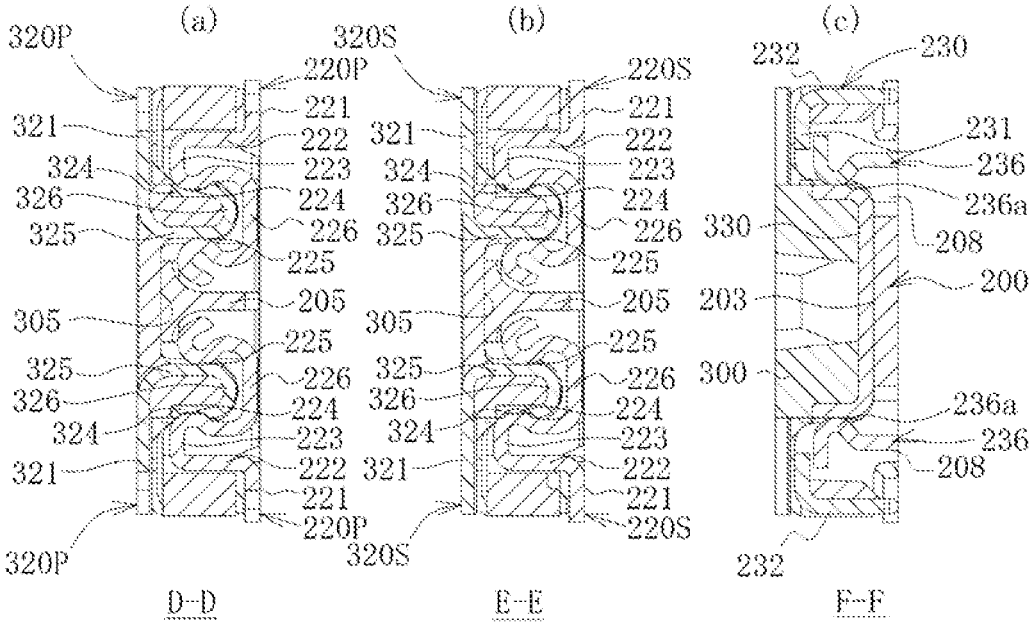
FIG. 8 are widthwise cross-sectional view of the substrate-to-substrate connector unit in FIG. 7, FIG. 8(*a*) is a cross-sectional view taken along the line D-D, FIG. 8(*b*) is a cross-sectional view taken along the line E-E, and FIG. 8(*c*) is a cross-sectional view taken along the line F-F.

FIGS. 7 and 8 show the receptacle connector 20 and the plug connector 30 fitted to each other. FIG. 7 is a plan view of the receptacle connector 20 and the plug connector 30 fitted to each other viewed from the side of the bottom surface (side of the surface mounted on the substrate) of the plug connector 30. FIG. 8(*a*) is a cross-sectional view taken along the line D-D in FIG. 7, FIG. 8(*b*) is a cross-sectional view taken along the line E-E in FIG. 7, and FIG. 8(*c*) is a cross-sectional view taken along the line F-F in FIG. 7.

As shown in FIGS. 7 and 8 as well as FIG. 1, the plug connector 30 mainly includes a block 300 made of an electrical insulating synthetic resin, a required number of contacts 320 held in the block 300, and reinforcement metal fittings 330 provided on longitudinal end portions of the block 300.

The material of the block 300 may be liquid crystal polymer (LCP), polyphenylene sulfide (PPS), poly butylene terephthalate (PBT) or polyamide (PA), although the material is not limited to these materials. The material of the block 300 may contain an inorganic filler, a reinforcement fiber or the like. The block 300 has a shape that conforms to the recess 203 of the housing 200, and has a groove 305 (FIG. 1) that houses the raised part 205.

As shown in FIGS. 1, 7, 8(*a*) and 8(*b*), the contacts 320 include signal contacts 320S having a smaller width and power supply contacts 320P having a greater width. However, all the contacts 320 may be signal contacts 320S. When both signal contacts 320S and power supply contacts 320P are provided, the signal contacts 320S and the power supply contacts 320P may have the same shape and dimensions. The contacts 320 are made of a conductive metal, such as copper or a copper alloy. Each contact 320 has a connection portion 321 to be mounted on the substrate, an inner contact portion 325 that rises from the connection portion 321 in the height direction of the block 300 and comes into contact with the inner contact portion 225 of the contact 220, an outer contact portion 324 that is opposed to the inner contact portion 325 and comes into contact with the outer contact portion 224 of the contact 220, and a coupling portion 326 that couples the inner contact portion 325 and the outer contact portion 324 to each other. The contact 320 has only to be able to come into contact with the contact 220 of the receptacle connector 20, and the structure of the contact 320 is not limited to the illustrated example. For example, the contact 320 may have only one contact portion (324 or 325).

The reinforcement metal fitting 330 is integrated with the block 300 in the injection shaping of the block 300. That is, the reinforcement metal fitting 330 is held (set) in a die (not shown) as an insert body and then fixed to (made to be held in) the block 300 by injecting (charging) a synthetic resin material of the block 300 into the space for forming the block 300. Alternatively, the reinforcement metal fitting 330 may be fixed to the block 300 by insertion (press fitting) and/or bonding after the block 300 is formed.

The reinforcement metal fitting 330 is formed by bending an intermediate piece having a predetermined shape and predetermined dimensions formed by cutting, preferably, a plate material made of a conductive metal such as copper or copper alloy. As shown in FIG. 1, the reinforcement metal fitting 330 is formed to cover a longitudinal end portion of the block 300 with four surfaces thereof, that is, an upper surface, a left side surface, a right side surface, and an end surface thereof. The reinforcement metal fitting 330 further has a connection piece 330*a* that protrudes from the block 300 on the bottom surface side and is to be mounted on and fixed to the substrate.

As can be seen in FIG. 8(*a*), the contact 320P having a greater width of the plug connector 30 is inserted between the outer contact portion 224 and the inner contact portion 225 of the contact 220P having a greater width of the receptacle connector 20 and is in contact with the contact 220P at two points. It can also be seen that the raised part 205 of the receptacle connector 20 is inserted in the groove 305 of the plug connector 30.

Similarly, as can be seen in FIG. 8(*b*), the contact 320S having a smaller width of the plug connector 30 is inserted between the outer contact portion 224 and the inner contact portion 225 of the contact 220S having a smaller width of the receptacle connector 20 and is in contact with the contact 220S at two points. It can also be seen that the raised part 205 of the receptacle connector 20 is inserted in the groove 305 of the plug connector 30.

As can be seen in FIG. 8(*c*), the block 300 of the plug connector 30 is inserted into the recess 203 of the receptacle connector 20, and the reinforcement metal fitting 330 of the plug connector 30 is in contact with the contact pieces 236 supported on the cantilever resilient pieces 235 of the reinforcement metal fitting 230 of the receptacle connector 20.

Figure 9:
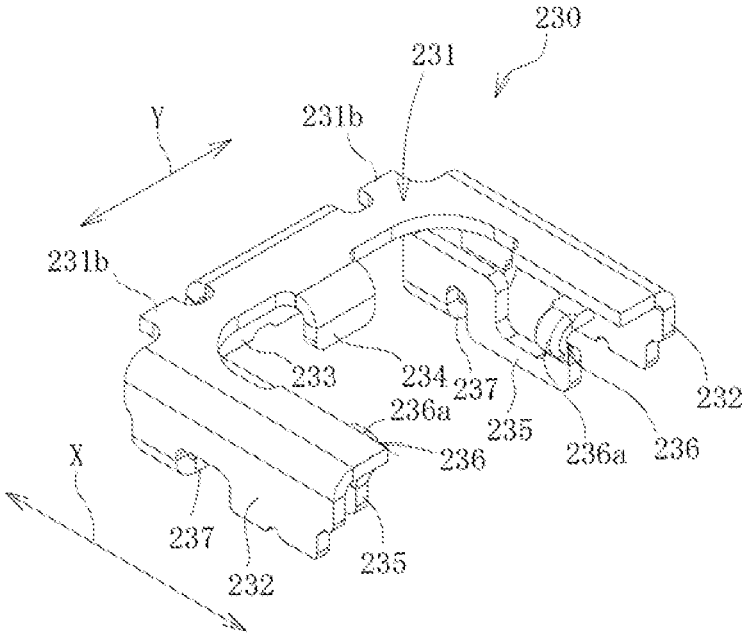
FIG. 9 show a variation example of the reinforcement metal fitting used in the receptacle connector in FIG. 1, FIG. 9(*a*) is a perspective view of the reinforcement metal fitting viewed from the side of an upper surface thereof, and FIG. 9(*b*) is a perspective view of the reinforcement metal fitting viewed from the side of a lower surface thereof.
Figure 9:
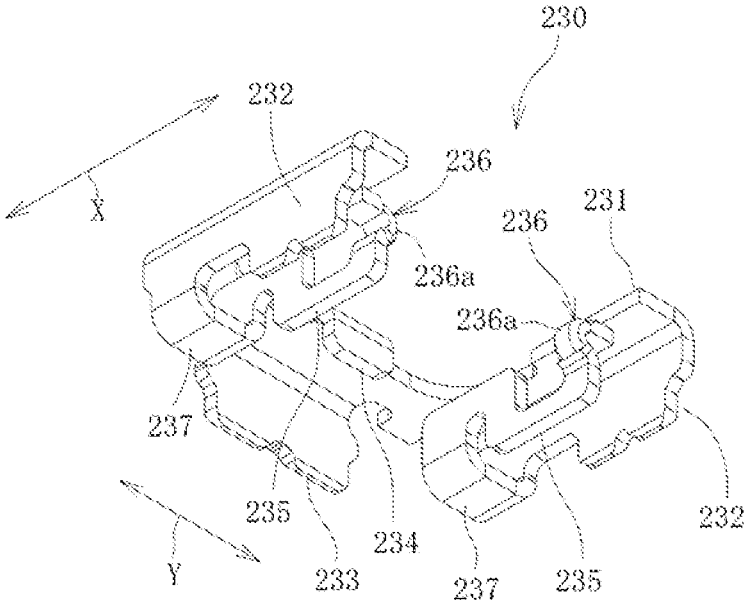

Next, with reference to FIG. 9, a variation example of the reinforcement metal fitting 230 used in the receptacle connector 20 according to the embodiment of the present invention will be described. With the reinforcement metal fitting 230 described above with reference to FIG. 6, the cantilever resilient piece 235 is integrally coupled to one hanging side wall 232 by the vertical extension wall 237 that extends from the side edge of the hanging side wall 232 located on the outer side in the longitudinal direction X toward the other, opposed hanging side wall 232. However, according to this variation example, as shown in FIG. 9, the cantilever resilient piece 235 is integrally coupled to the hanging side wall 232 by a horizontal extension wall 237 that extends from a lower end of a portion of the hanging side wall 232 located on the outer side in the longitudinal direction X toward the other, opposed hanging side wall 232.

The reinforcement metal fitting 330 is the same as the reinforcement metal fitting 230 shown in FIG. 6 in that the cantilever resilient piece 235 extends in the arrangement direction of the contacts 220 (longitudinal direction X of the housing 200). In order that the cantilever resilient piece 235 has a predetermined spring length, a free end portion of the cantilever resilient piece 235 is exposed from the resin material of the housing 200, and the remaining portion is embedded in the resin material of the housing 200. However, the whole of the cantilever resilient piece 235 may be exposed from the resin material of the housing 200. The reinforcement metal fitting 230 further has a contact piece 236 that extends from the free end portion of the cantilever resilient piece 235 and comes into contact with the plug connector 30 when the receptacle connector 20 and the plug connector 30 are fitted to each other. The contact piece 236 is supported on the cantilever resilient piece 235 having a predetermined spring length, and therefore, even if the profile of the receptacle connector 20 is reduced, a sufficient spring length can be ensured, and the contact piece 236 can come into stable contact with the plug connector 30.

In this variation example, again, the contact piece 236 extends in the height direction of the housing 200 or, in other words, extends from the free end portion of the cantilever resilient piece 235 toward the top wall 231.

When viewed in the direction of fitting the plug connector 30 to the receptacle connector 20, a tip end portion of the contact piece 236 is preferably hidden by the top wall 231. This prevents an inappropriate fitting, such as a back fitting of the plug connector 30.

Furthermore, the contact piece 236 preferably has a curved portion 236*a* between a base end portion thereof and the tip end portion thereof, the curved portion 236*a* being inwardly convex or, in other words, protruding to the inside of the recess 203. This facilitates smooth insertion and removal of the plug connector 30 into and from between the contact pieces 236 opposed in the widthwise direction Y.

Figure 10:
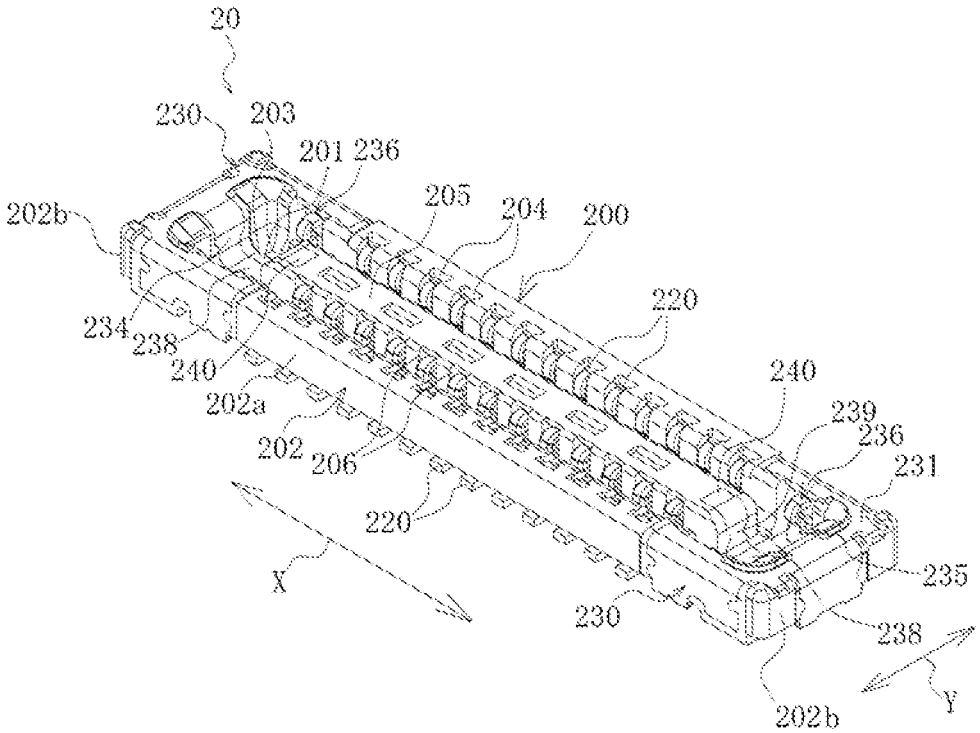
FIG. 10 is a top perspective view of a receptacle connector according to another embodiment of the present invention.
Figure 11:
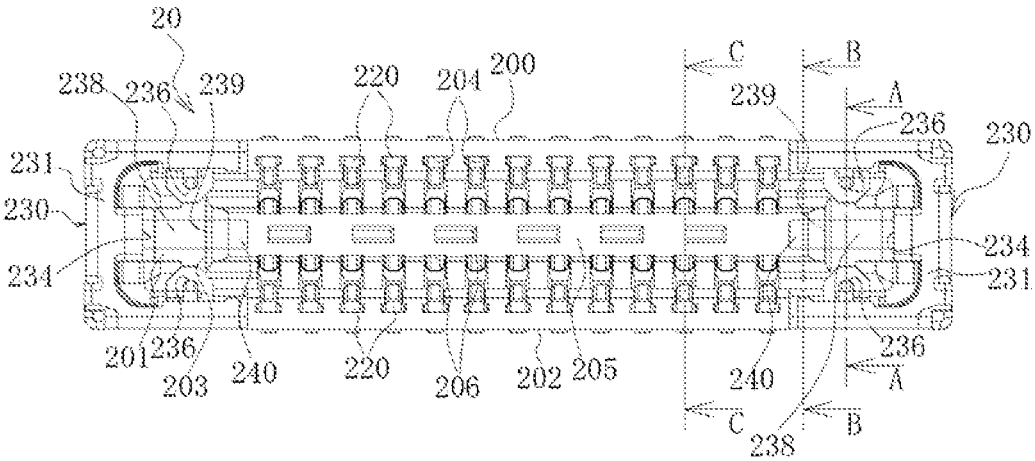
FIG. 11 is a plan view of the receptacle connector in FIG. 10.

FIG. 10 is a top perspective view of a receptacle connector 20 according to another embodiment of the present invention. The receptacle connector 20 is also a part of a substrate-to-substrate connector unit that electrically connects substrates to each other by fitting the receptacle connector 20 and a plug connector (not shown) similar to the plug connector 30 in the embodiment described earlier, and the plug connector and the receptacle connector 20 can be attached to and detached from each other.

As shown in FIG. 10, the receptacle connector 20 mainly includes a housing 200, a required number of contacts 220, and a reinforcement metal fitting 230.

The housing 200 is fabricated by injection shaping or the like of an electrical insulating synthetic resin material. The synthetic resin material may be liquid crystal polymer (LCP), polyphenylene sulfide (PPS), poly butylene terephthalate (PBT) or polyamide (PA), although the synthetic resin material is not limited to these materials. The material of the housing 200 may contain an inorganic filler, a reinforcement fiber or the like.

The housing 200 substantially has the shape of a flat rectangular parallelepiped. The housing 200 has a bottom wall 201 and a circumferential wall 202 rising from a circumferential edge of the bottom wall 201. The bottom wall 201 and the circumferential wall 202 define a recess 203 that opens at the top thereof.

The circumferential wall 202 has side wall portions 202*a* opposed to each other that extend in an arrangement direction (longitudinal direction of the housing 200) X of the contacts 220, and end wall portions 202*b* opposed to each other that extend in a direction (widthwise direction of the housing) Y perpendicular to the arrangement direction of the contacts 220. In an inner surface of the side wall portion 202*a*, outer portion housing grooves 204 substantially having a T-shape in plan view each of which houses an outer portion of each contact 220 are formed. The outer portion housing groove 204 penetrates the housing 200 in a height direction (thickness direction). The outer portion housing groove 204 is preferably dimensioned to be in pressure contact with the contact when the contact 220 is inserted and fitted in the outer portion housing groove 204.

Alternatively, the contact 220 may be integrated with the housing 200 in the injection shaping of the housing 200. That is, the contacts 220 may be held (set) in a die (not shown) as insert bodies and then fixed to (made to be held in) the housing 200 by injecting (charging) an electrical insulating synthetic resin material, which is to form the housing 200, into the space for forming the housing 200.

The housing 200 further has a raised part 205 substantially having a rectangular shape in plan view that is formed on the bottom wall 201 and is spaced apart from the circumferential wall 202. Therefore, the recess 203 is defined as an annular space. In side surfaces of the raised part 205 that is opposed to the side wall portions 202*a*, inner portion housing grooves 206 that house inner portions of the contacts 220 are formed. The inner portion housing grooves 206 are provided at locations where the inner portion housing grooves 206 are opposed to the outer portion housing grooves 204 and extend in the height direction of the housing 200. In the inner portion housing groove 206, an inclined portion 206*a* (FIG. 12(*c*)) having a curved shape is formed.

The inclined portion 206*a* conforms to an inclined portion 225*a* of an inner contact portion 225 of the contact 220. The inclined portion 206*a* is a portion that adjusts a movement (supporting function) for preventing lifting of the inner contact portion 225 of the contact 220 or deformation of the contact 220 when the plug connector 30, which is a counterpart connector, is removed, and ensures a stable connection after repeated insertions and removals of the plug connector 30. The shape and size of the inclined portion 206*a* of the inner portion housing groove 206 depend on the shape and size of the inclined portion 225*a* of the inner contact portion 225 of the contact 220, and are appropriately determined by considering the functions thereof described above, the connection stability, the workability and the like.

Figure 12:
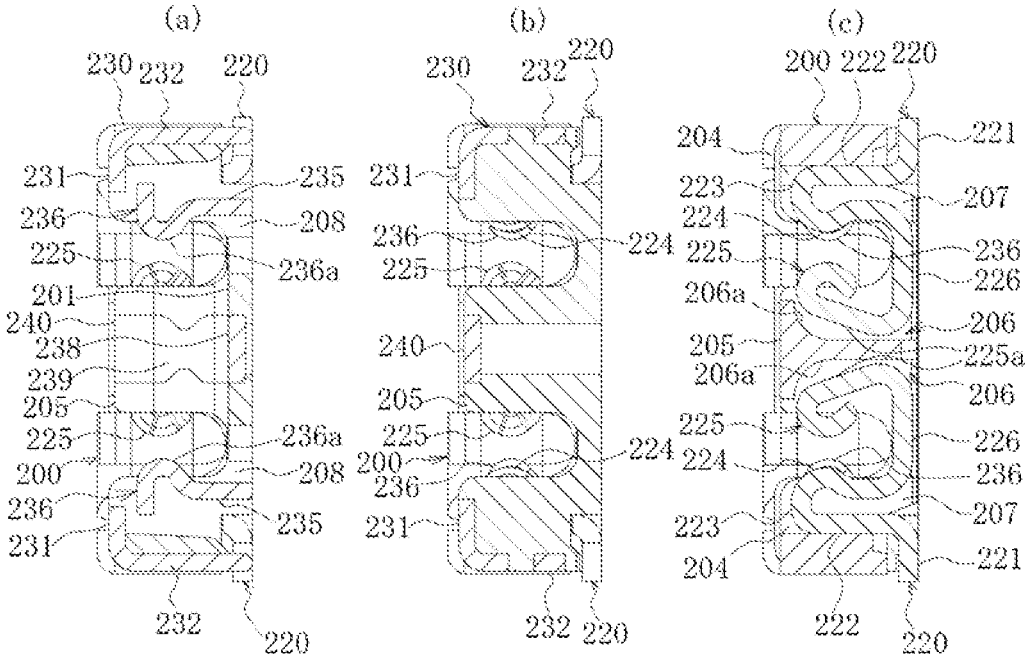
FIG. 12 are widthwise cross-sectional view of the receptacle connector in FIG. 10, FIG. 12(*a*) is a cross-sectional view taken along the line A-A in FIG. 11, FIG. 12(*b*) is a cross-sectional view taken along the line B-B in FIG. 11, and FIG. 12(*c*) is a cross-sectional view taken along the line C-C in FIG. 11.

As shown in FIG. 12(*c*), openings 207 that are in communication with the outer portion housing grooves 204 and the inner portion housing grooves 206 are formed in the bottom wall 201. When assembling the contacts 220 to the housing 200 by insertion, the contacts 220 can be inserted through the openings 207 from the bottom surface side.

As in the embodiment described earlier, the contacts 220 are made of a conductive metal, preferably copper or a copper alloy. In this embodiment, all the contacts 220 have the same shape and dimensions.

As shown in FIG. 12(*c*), each contact 220 has a connection portion 221 to be mounted on the substrate, a held portion 222 that extends from the connection portion 221 in the height direction of the housing 200 and is held in the outer portion housing groove 204, an extension portion 223 that extends from an upper end of the held portion 222 toward the raised part 205, an outer contact portion 224 that is convexly curved toward the raised part 205, an inner contact portion 225 that is opposed to the outer contact portion 224 and is convexly curved toward the outer contact portion 224, and a coupling portion 226 that has a U-shaped cross section and couples the outer contact portion 224 and the inner contact portion 225 to each other. The contact 220 has only to be able to come into contact with a contact of a plug connector, such as the plug connector shown in FIG. 1, and the structure of the contact 220 is not limited to the illustrated example. For example, the contact 220 may have only one contact portion (224 or 225).

The inclined portion 225*a* formed on the inner contact portion 225 is configured to conform to (i.e., have a shape substantially corresponding to the shape of) the inclined portion 206*a* of the inner portion housing groove 206 of the housing 200. Thus, the inclined portion 225*a* of the inner contact portion 225 is a portion that adjusts a movement (supporting function) for preventing lifting of the inner contact portion 225 of the contact 220 or deformation of the contact 220 when the plug connector, which is a counterpart connector, is removed, and ensures a stable connection after repeated insertions and removals of the plug connector. The shape and size of the inclined portion 225*a* formed on the inner contact portion 225 depend on the shape and size of the inclined portion 206*a* of the inner portion housing groove 206 of the housing 200, and are appropriately determined by considering the functions thereof described above, the connection stability, the workability and the like.

Unlike the inclined portion 225*a* according to the embodiment described earlier, which is located close to the tip end portion of the inner contact portion 225, the inclined portion 225*a* of the inner contact portion 225 of each contact 220 according to this embodiment is located close to a base portion of the inner contact portion 225 connected to the coupling portion 226. Therefore, when the plug connector, which is a counterpart connector, is removed, the inclined portion 206*a* of the inner portion housing groove 206 of the housing 200 more reliably supports the inclined portion 225*a*, thereby preventing lifting of the inner contact portion 225 of the contact 220 or deformation of the contact 220. In this way, a stable connection is ensured after repeated insertions and removals of the plug connector.

Referring back to FIG. 10, the reinforcement metal fitting 230 is made of a metal, preferably a conductive metal such as copper or copper alloy, and partially covers longitudinal end portions of the housing 200. The end portions of the housing 200 are reinforced in this way. The reinforcement metal fitting 230 serves also as a fixing tab that fixes the housing 200 to the substrate.

Figure 13:
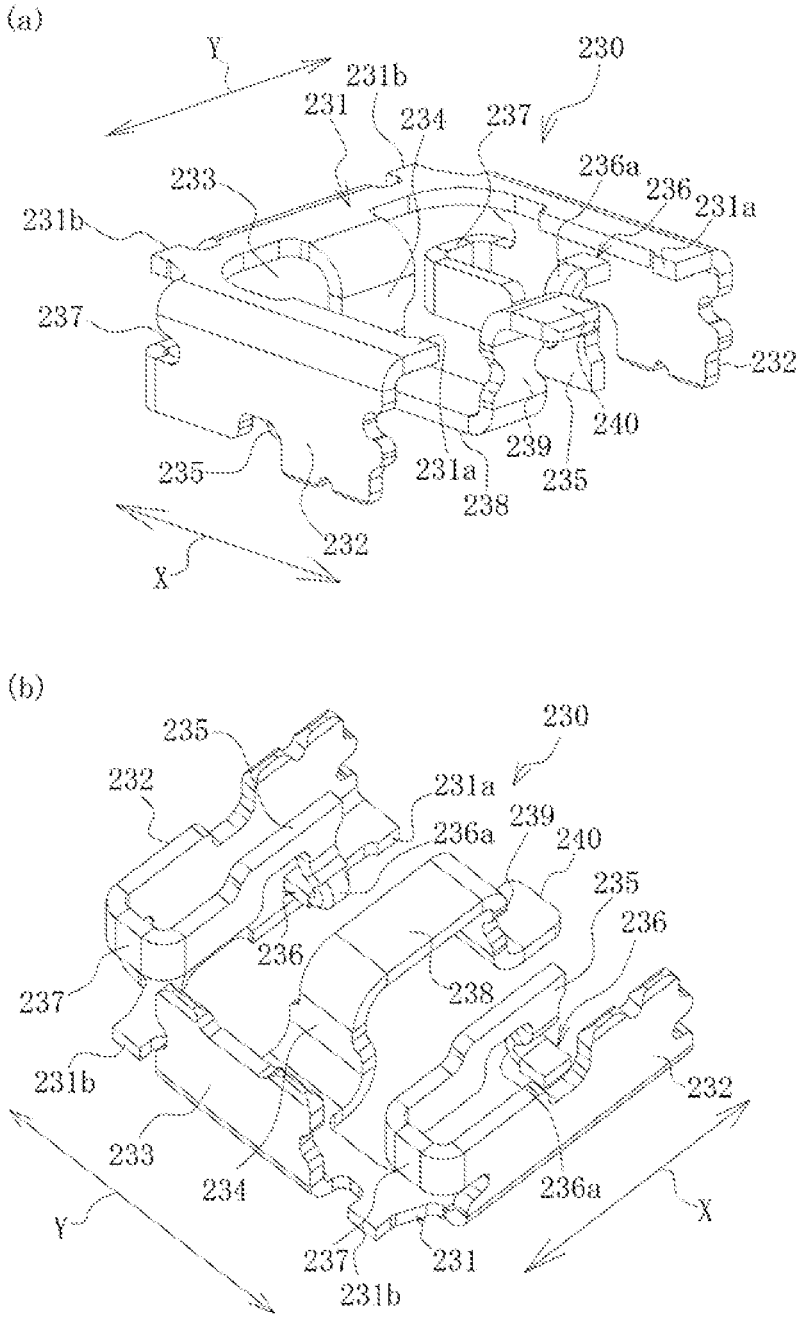
FIG. 13 shows a reinforcement metal fitting provided on a longitudinal end portion of a housing of the receptacle connector in FIG. 10, FIG. 13(*a*) is a perspective view of the reinforcement metal fitting viewed from the side of an upper surface thereof, and FIG. 13(*b*) is a perspective view of the reinforcement metal fitting viewed from the side of a lower surface thereof.

FIG. 13 shows the reinforcement metal fitting 230 alone. The reinforcement metal fitting 230 is integrated with the housing 200 in the injection shaping of the housing 200. That is, the reinforcement metal fitting 230 is held (set) in a die (not shown) as an insert body and then fixed to (made to be held in) the housing 200 by injecting (charging) a synthetic resin material of the housing 200 into the space for forming the housing 200. Alternatively, the reinforcement metal fitting 230 may be fixed to the housing 200 by insertion (press fitting) and/or bonding after the housing 200 is formed.

The reinforcement metal fitting 230 mainly includes a top wall 231, a pair of hanging side walls 232 opposed in a widthwise direction Y of the housing 200, a hanging end wall 233, a hanging piece 234, cantilever resilient pieces 235 and contact pieces 236. The reinforcement metal fitting 230 is formed by bending an intermediate piece having a predetermined shape and predetermined dimensions formed by cutting a metal plate material by stamping, for example.

The top wall 231 substantially have a C-shape in plan view and extends along an upper surface of the side wall portion 202*a* and an upper surface of the end wall portion 202*b* of the circumferential wall 202 (surfaces opposite to the surface mounted on the substrate) at a longitudinal end portion of the housing 200. In opposed inner side and a rear side of the top wall 231, engagement portions 231*a* and 231*b* to be engaged with the housing 200 are preferably formed. The engagement portions 231*a* are engaged with the housing 200 in a longitudinal direction X and restricts a relative movement in the longitudinal direction X. The engagement portions 231*b* are engaged with the housing 200 in the widthwise direction Y and restricts a relative movement in the widthwise direction Y.

The hanging side wall 232 hangs from an outer side edge of the top wall 231 along an outer surface of the side wall portion 202*a* of the circumferential wall 202 and is mounted on and fixed to the substrate at the lower end thereof. The hanging end wall 233 hangs from a rear side (outer end edge) of the top wall 231 along an outer surface of the end wall portion 202*b* of the circumferential wall 202 and is mounted on and fixed to the substrate at the lower end thereof. The hanging side walls 232 and the hanging end wall 233 are flush with the outer surface of the circumferential wall 202.

The hanging piece 234 hangs from an inner end edge of the top wall 231 along an inner surface of the end wall portion 202*b* of the circumferential wall 202, and the end wall portion 202*b* is held between the hanging piece 234 and the hanging end wall 233. A bottom piece 238 horizontally extends from a tip end of the hanging piece 234, and an opposed piece 239, which is opposed to the hanging piece 234, rises from a tip end of the bottom piece 238. The hanging piece 234, the bottom piece 238 and the opposed piece 239 form a groove shape as a whole, and an end piece 240 horizontally extends from a tip end of the opposed piece 239. As shown in FIG. 10, the hanging piece 234 is flush with the inner surface of the end wall portion 202*b* of the circumferential wall 202, and the opposed piece 239 is flush with an end surface of the raised part 205 of the housing 200 that is opposed to the inner surface of the end wall portion 202*b*. As shown in FIG. 12(*a*), the bottom piece 238 is flush with the inner surface of the bottom wall 201 of the housing 200. As shown in FIG. 12(*b*), the end piece 240 is flush with the upper surface of the raised part 205 of the housing 200.

The cantilever resilient piece 235 is integrally coupled to each hanging side wall 232 by a vertical extension wall 237 that extends from a side edge of the hanging side wall 232 located on the outer side in the longitudinal direction X toward the other hanging side wall 232. The cantilever resilient piece 235 extends in the arrangement direction of the contacts 220 (longitudinal direction X of the housing 200). As shown in FIGS. 10 and 12(*a*), in order that the cantilever resilient piece 235 has a predetermined spring length, a free end portion of the cantilever resilient piece 235 is exposed from the resin material of the housing 200, and the remaining portion is embedded in the resin material of the housing 200. To expose the free end portion of the cantilever resilient piece 235, a through-hole 208 (see FIG. 12(*a*)) is formed in the bottom wall 201 of the housing 200 at a part near the free end portion of the cantilever resilient piece 235.

The whole of the cantilever resilient piece 235 may be exposed from the resin material of the housing 200. The reinforcement metal fitting 230 further has a contact piece 236 that extends from the free end portion of the cantilever resilient piece 235 and comes into contact with the plug connector when the receptacle connector 20 and the plug connector are fitted to each other. The contact piece 236 is supported on the cantilever resilient piece 235 having a predetermined spring length, and therefore, even if the profile of the receptacle connector 20 is reduced, a sufficient spring length can be ensured, and the contact piece 236 can come into stable contact with the plug connector.

According to a preferred aspect, the contact piece 236 extends in the height direction of the housing 200 or, in other words, extends from the free end portion of the cantilever resilient piece 235 toward the top wall 231. According to a more preferred aspect, when viewed in the direction of fitting the plug connector 30 to the receptacle connector 20, a tip end portion of the contact piece 236 is hidden by the top wall 231. This prevents an inappropriate fitting, such as a back fitting of the plug connector 30.

According to a more preferred aspect, the contact piece 236 has a curved portion 236*a* between a base end portion thereof and the tip end portion thereof, the curved portion 236*a* being inwardly convex or, in other words, protruding to the inside of the recess 203. This facilitates smooth insertion and removal of the plug connector 30 into and from between the contact pieces 236 opposed in the widthwise direction Y.

The receptacle connector 20 can also provide the same effects and advantages as the receptacle connector 20 according to the embodiment described earlier.

INDUSTRIAL APPLICABILITY

The present invention can provide a receptacle connector that comes into good contact with a counterpart connector via a contact piece of a reinforcement metal fitting even when the profile of the connector is reduced.

REFERENCE SIGNS LIST

10 substrate-to-substrate connector unit
20 receptacle connector
200 housing
201 bottom wall
202 circumferential wall
202*a* side wall portion
202*b* end wall portion
203 recess
204 outer portion housing groove
205 raised part
206 inner portion housing groove
207 opening
208 through-hole
220 contact
220P power supply contact
220S signal contact
221 connection portion
222 held portion
223 extension portion
224 outer contact portion
225 inner contact portion
226 coupling portion
230 reinforcement metal fitting
231 top wall
231*a*, 231*b* engagement portion
232 hanging side wall
233 hanging end wall
234 hanging piece
235 cantilever resilient piece
236 contact piece
236*a* curved portion
237 extension wall
238 bottom piece
239 opposed piece
240 end piece

The invention claimed is:

1. A receptacle connector of a substrate-to-substrate connector unit that electrically connects substrates by fitting the receptacle connector mounted on one of the substrates and a plug connector mounted on another of the substrates to each other, comprising: a housing in which a recess for housing the plug connector is formed, the recess opening at a side opposite to a surface mounted on the substrate; a required number of contacts arranged between end portions of the housing; and reinforcement metal fittings each of which is provided on one of the end portions of the housing, wherein the reinforcement metal fitting has a cantilever resilient piece that extends in an arrangement direction of the contacts, and a contact piece that extends from a free end portion of the cantilever resilient piece and comes into contact with the plug connector when the receptacle connector and the plug connector are fitted to each other.

2. The receptacle connector according to claim 1, wherein the contact piece extends in a height direction of the housing.

3. The receptacle connector according to claim 1, wherein the reinforcement metal fitting has a top wall formed along a surface of the housing that is opposite to the surface mounted on the substrate, and a tip end portion of the contact piece is hidden by the top wall when viewed in a direction of fitting the plug connector to the receptacle connector.

4. The receptacle connector according to claim 1, wherein the contact piece has an inwardly convex curved portion between a base end portion thereof and a tip end portion thereof.

5. The receptacle connector according to claim 1, wherein the reinforcement metal fitting has two pieces of the cantilever resilient pieces and two pieces of the contact pieces, the two cantilever resilient pieces are disposed at locations where the cantilever resilient pieces are opposed in a direction perpendicular to the arrangement direction, and the two contact pieces are disposed at locations where the contact pieces are opposed in the direction perpendicular to the arrangement direction.

6. The receptacle connector according to claim 3, wherein the reinforcement metal fitting is fixed to the housing by integrally forming the reinforcement metal fitting with the housing when forming the housing.

7. The receptacle connector according to claim 2, wherein the contact piece has an inwardly convex curved portion between a base end portion thereof and a tip end portion thereof.

8. The receptacle connector according to claim 3, wherein the contact piece has an inwardly convex curved portion between a base end portion thereof and a tip end portion thereof.

9. The receptacle connector according to claim 2, wherein the reinforcement metal fitting has two pieces of the cantilever resilient pieces and two pieces of the contact pieces, the two cantilever resilient pieces are disposed at locations where the cantilever resilient pieces are opposed in a direction perpendicular to the arrangement direction, and the two contact pieces are disposed at locations where the contact pieces are opposed in the direction perpendicular to the arrangement direction.

10. The receptacle connector according to claim 3, wherein the reinforcement metal fitting has two pieces of the cantilever resilient pieces and two pieces of the contact pieces, the two cantilever resilient pieces are disposed at locations where the cantilever resilient pieces are opposed in a direction perpendicular to the arrangement direction, and the two contact pieces are disposed at locations where the contact pieces are opposed in the direction perpendicular to the arrangement direction.

11. The receptacle connector according to claim 4, wherein the reinforcement metal fitting has two pieces of the cantilever resilient pieces and two pieces of the contact pieces, the two cantilever resilient pieces are disposed at locations where the cantilever resilient pieces are opposed in a direction perpendicular to the arrangement direction, and the two contact pieces are disposed at locations where the contact pieces are opposed in the direction perpendicular to the arrangement direction.

12. The receptacle connector according to claim 5, wherein the reinforcement metal fitting has two pieces of the cantilever resilient pieces and two pieces of the contact pieces, the two cantilever resilient pieces are disposed at locations where the cantilever resilient pieces are opposed in a direction perpendicular to the arrangement direction, and the two contact pieces are disposed at locations where the contact pieces are opposed in the direction perpendicular to the arrangement direction.

13. The receptacle connector according to claim 6, wherein the reinforcement metal fitting has two pieces of the cantilever resilient pieces and two pieces of the contact pieces, the two cantilever resilient pieces are disposed at locations where the cantilever resilient pieces are opposed in a direction perpendicular to the arrangement direction, and the two contact pieces are disposed at locations where the contact pieces are opposed in the direction perpendicular to the arrangement direction.

14. The receptacle connector according to claim 6, wherein the reinforcement metal fitting is fixed to the housing by integrally forming the reinforcement metal fitting with the housing when forming the housing.

15. The receptacle connector according to claim 9, wherein the reinforcement metal fitting is fixed to the housing by integrally forming the reinforcement metal fitting with the housing when forming the housing.

16. The receptacle connector according to claim 12, wherein the reinforcement metal fitting is fixed to the housing by integrally forming the reinforcement metal fitting with the housing when forming the housing.

* * * * *